US007288003B2

(12) United States Patent
Ono et al.

(10) Patent No.: US 7,288,003 B2
(45) Date of Patent: Oct. 30, 2007

(54) SOCKET DEVICE

(75) Inventors: Hisahiro Ono, Kadoma (JP); Wen-Liang Wen, Chung Ho (TW)

(73) Assignees: Jess-Link Products Co., Ltd., Taipei County (TW); Matsushita Electric Works Ltd., Osaka (JP)

( * ) Notice: Subject to any disclaimer, the term of this patent is extended or adjusted under 35 U.S.C. 154(b) by 42 days.

(21) Appl. No.: 11/431,700

(22) Filed: May 11, 2006

(65) Prior Publication Data

US 2007/0207653 A1 Sep. 6, 2007

(30) Foreign Application Priority Data

Mar. 1, 2006 (TW) ..... 95203378 U

(51) Int. Cl.
*H01R 16/648* (2006.01)

(52) U.S. Cl. ..... 439/607; 439/70

(58) Field of Classification Search ..... 439/607–609, 439/70, 680, 876

See application file for complete search history.

(56) References Cited

U.S. PATENT DOCUMENTS

| | | | | |
|---|---|---|---|---|
| 7,077,664 | B1 * | 7/2006 | Wang et al. | 439/70 |
| 7,086,902 | B1 * | 8/2006 | Yang | 439/607 |
| 7,112,083 | B2 * | 9/2006 | Nishio et al. | 439/331 |
| 7,128,607 | B2 * | 10/2006 | Li | 439/607 |
| 7,147,481 | B2 * | 12/2006 | Yang | 439/71 |
| 2006/0105631 | A1 * | 5/2006 | Yang | 439/607 |

* cited by examiner

*Primary Examiner*—Hien Vu
(74) *Attorney, Agent, or Firm*—Rosenberg, Klein & Lee

(57) ABSTRACT

A socket device is installed on a circuit board of an electronic product and includes an insulating housing formed with a contained space for containing an electronic component, a plurality of terminals installed in the contained space, and a holding casing covered around the insulating housing. The insulating housing has at least one horizontal penetrating groove formed at two sides thereof. The terminals are electrically connected with the electronic component. The holding casing forms at least one elastic arm at its two sides, respectively. Each elastic arm forms a pressing portion from a top edge thereof to the contained space for pressing the electrical component, and a guiding portion transversely extended from a free end thereof to the contained space. Each guiding portion is slidably contained in the penetrating groove. Therefore, it can prevent the elastic arm twisted outwardly and the socket device from deforming during the assembly process.

13 Claims, 11 Drawing Sheets

SOCKET DEVICE

BACKGROUND OF THE INVENTION

1. Field of the Invention

The present invention relates to a socket device, and more particularly to the socket device is electrically connected with a circuit board of an electrical product and an IC module is fixed inside of the socket device.

2. Description of the Prior Art

Recently with the rapidly development of electronic technology, many electronic products usually equip with components, such as IC module and camera module. In the electronic products, socket devices or named electrical connectors are designed for holding the electrical components. However, it faces many challenges, and more particularly that the portable electronic products are imprudently fell out to cause a breakdown.

In order to increase the stabilization and durability of the electronic products, the socket devices usually have an insulating housing and a shielding casing that is fixed on the insulating casing, and a contained space is formed between the insulating housing and the shielding casing for containing the electronic component. The conventional electrical connectors usually provide an elastic piece that is obliquely upwardly formed from a side wall of a shielding casing to a contained space. The elastic piece extends downwardly and forms a pressing portion for pressing the electronic component in the contained space.

The conventional electrical connector has the following disadvantages:

1. The size of the socket device is small, and the elastic piece must be opened up before the electronic component is assembled into the insulating housing so that the elastic piece is easily twisted and inelastic;

2. While the electronic product falling out, the electronic component is easily escaped from the elastic piece to cause a breakdown; and 3. The shielding casing is integrally formed and the elastic piece must be inwardly expended so that it is complicated to manufacture by punching.

The inventor of the present invention recognizes the above shortage should be corrected and special effort has been paid to research this field. The present invention is presented with reasonable design and good effect to resolve the above problems.

SUMMARY OF THE INVENTION

It is a primary object of the present invention to provide a socket device that doesn't have a shape deformation during the assembly process, and if an electronic product falls out, an electronic component is firmly fixed in the socket device so as to increase the stabilization and durability of the electronic product.

It is another object of the present invention to provide a socket device that has a metal casing is easily made so as to reduce the difficulty of manufacturing of the socket device.

For achieving the primary objective stated above, the present invention provides a socket device that is installed on a circuit board of the electronic product for containing the electronic component, and includes an insulating housing, a plurality of terminals, and a holding casing. The insulating housing has a contained space for containing the electronic component, and each of two sides of the insulating housing respectively forms at least one horizontal penetrating groove. The terminals are installed in the contained space of the insulating housing and electrically connected with the electronic component. The holding casing is covered and fixed with an outside of the insulating housing, each of two sides of the holding casing respectively forms at least one elastic arm, each of the elastic arms respectively forms a pressing portion is formed from a top edge of the holding casing to the contained space for pressing the electrical component, and a guiding portion is transversely extended from a free end to the contained space, each of the guiding portions is respectively slidably contained in the penetrating groove of the insulating housing for preventing the elastic arm outwardly twisted and the electronic component upwardly floated.

For achieving the other objective stated above of the socket device of the present invention, the holding casing is composed of a pair of U-shaped semi-holding casings. Each of the semi-holding casings respectively has a housing wall and a pair of side walls are installed on two sides of the housing wall. Each of the side walls of the semi-holding casing respectively has a transverse seam. The elastic arm is disposed above the transverse seam, and a holding arm is disposed below the transverse seam.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The above and further advantages of this invention may be better understood by referring to the following description, taken in conjunction with the accompanying drawings, in which.

The drawings will be described further in connection with the following detailed description of the present invention.

DETAILED DESCRIPTION OF THE PREFERRED EMBODIMENTS

Figure 1:
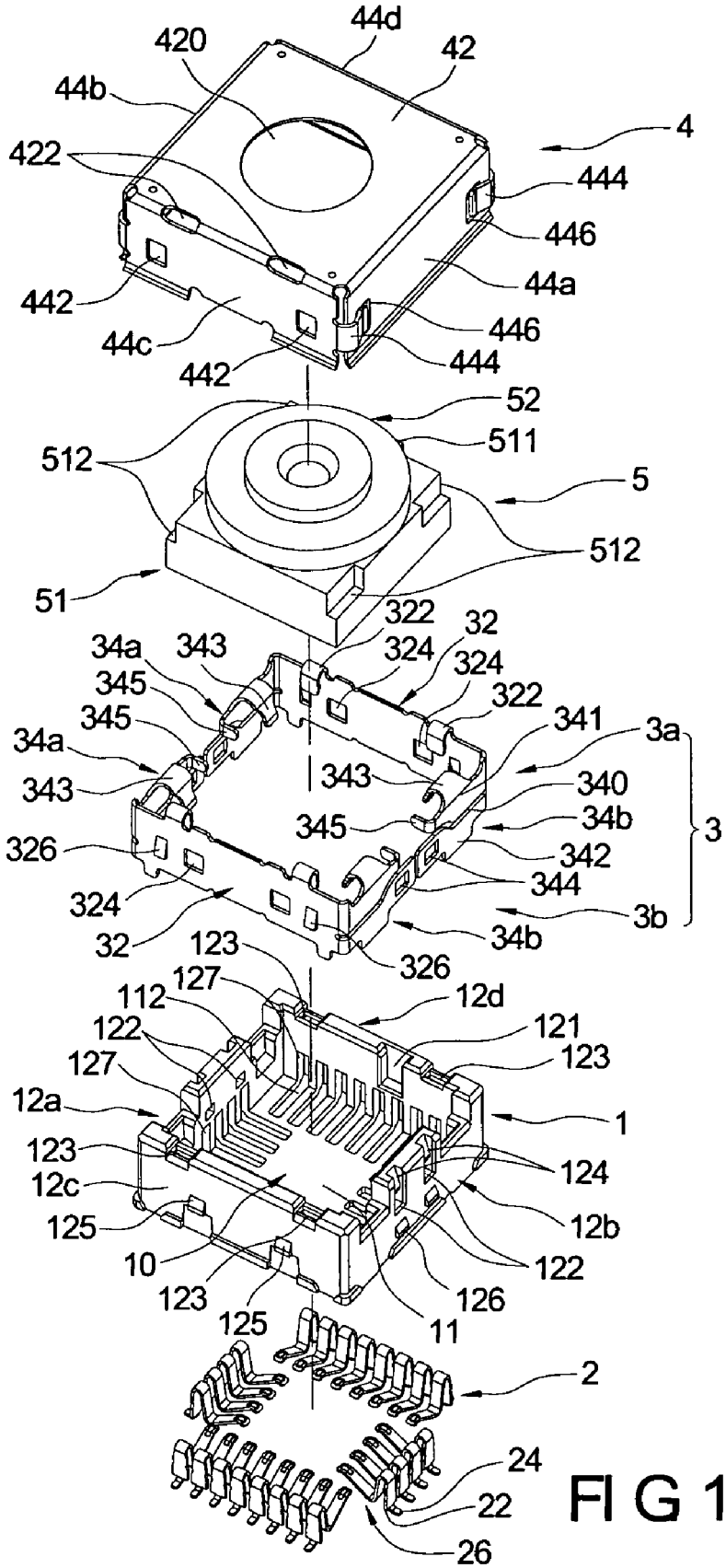
FIG. 1 is an exploded perspective view of a socket device of the present invention.
Figure 2:
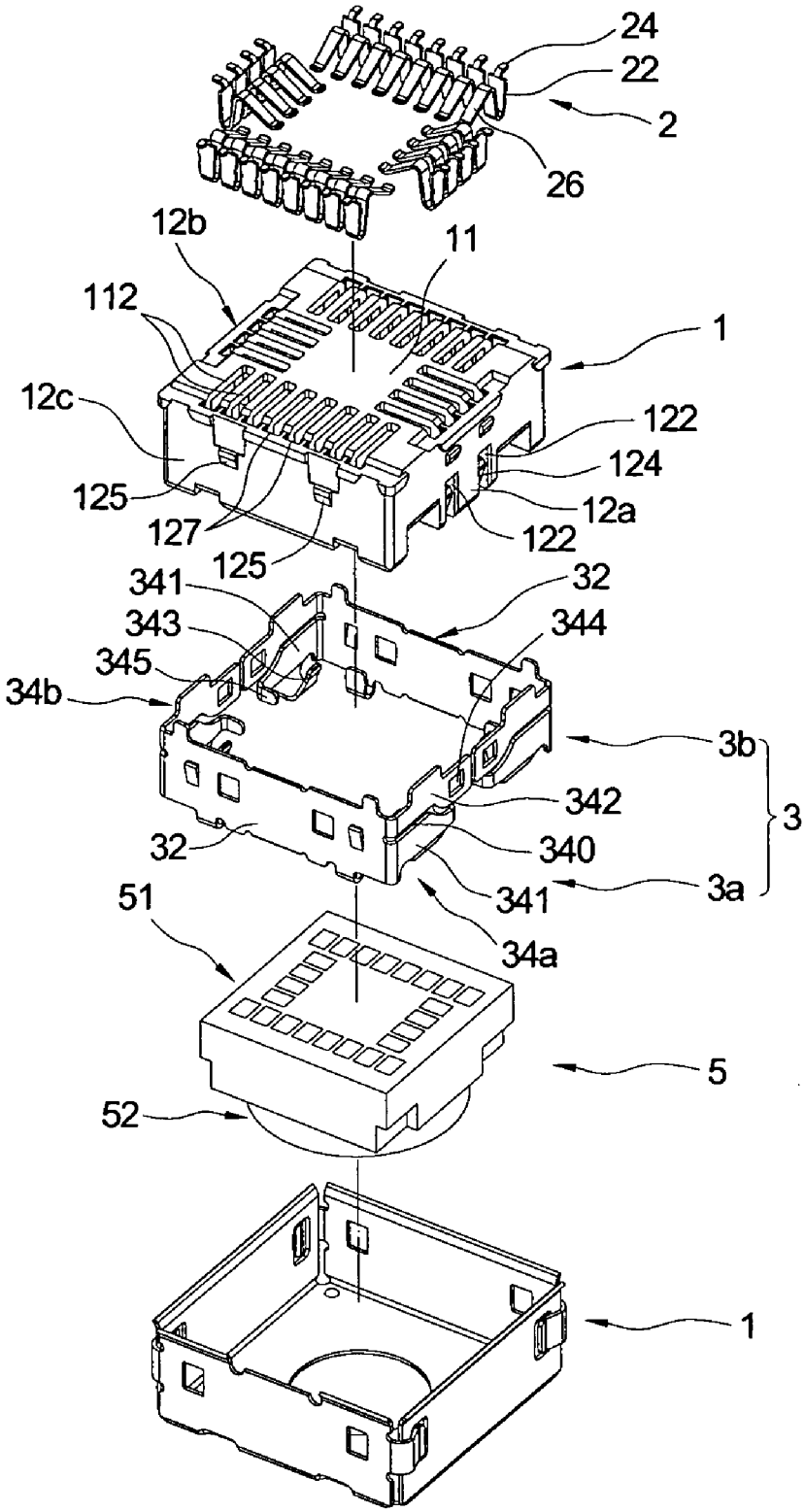
FIG. 2 is an exploded perspective view taken from a different angle of the socket device of the present invention.

References are made to FIG. 1 and FIG. 2, which are exploded perspective views of a socket device of the present invention. The present invention provides a socket device is installed on a circuit board (not shown) of an electronic product for containing an electronic component 5. In this embodiment, the electronic component 5 is applied to a camera module and has a base portion 51 and a lens portion 52. The socket device includes an insulating housing 1, a plurality of terminals 2, a holding casing 3, and a shielding casing 4.

The insulating housing 1 has a bottom wall 11 and four side walls 12*a*, 12*b*, 12*c*, 12*d* are mutually connected which collectively form a contained space 10 for containing the electronic component 5. Each of the opposite side walls 12*a*, 12*b* of the insulating housing 1 respectively forms at least one horizontal penetrating groove 122. In this embodiment, each of the side walls 12*a*, 12*b* respectively has a pair of penetrating grooves 122.

The terminals 2 are installed in the contained space 10 of the insulating housing 1 and electrically connected with the electronic component 5 for transmitting signals of the electronic component 5 to the circuit board of the electronic product.

Each of four inner surfaces of the insulating housing 1 respectively forms a plurality of terminal-fixing grooves 127. The terminal-fixing grooves 127 are communicated with terminal through grooves 112 are installed on a bottom wall 11 of the insulating housing 1 so that the terminals 2 are installed in the contained space 10. Each of the terminals 2 respectively has a fixed portion 22, a welding portion 24, and a contacting portion 26. The fixed portion 22 is fixed in the terminal-fixing groove 127 of the insulating housing 1. The welding portion 24 is downwardly extended from the fixed portion 22 and passed through the terminal through groove 112 of the insulating housing 1 for electrically connecting with the circuit board. The contacting portion 26 is extended from the fixed portion 22 to the contained space 10 for pushing the electronic component 5.

Figure 3:
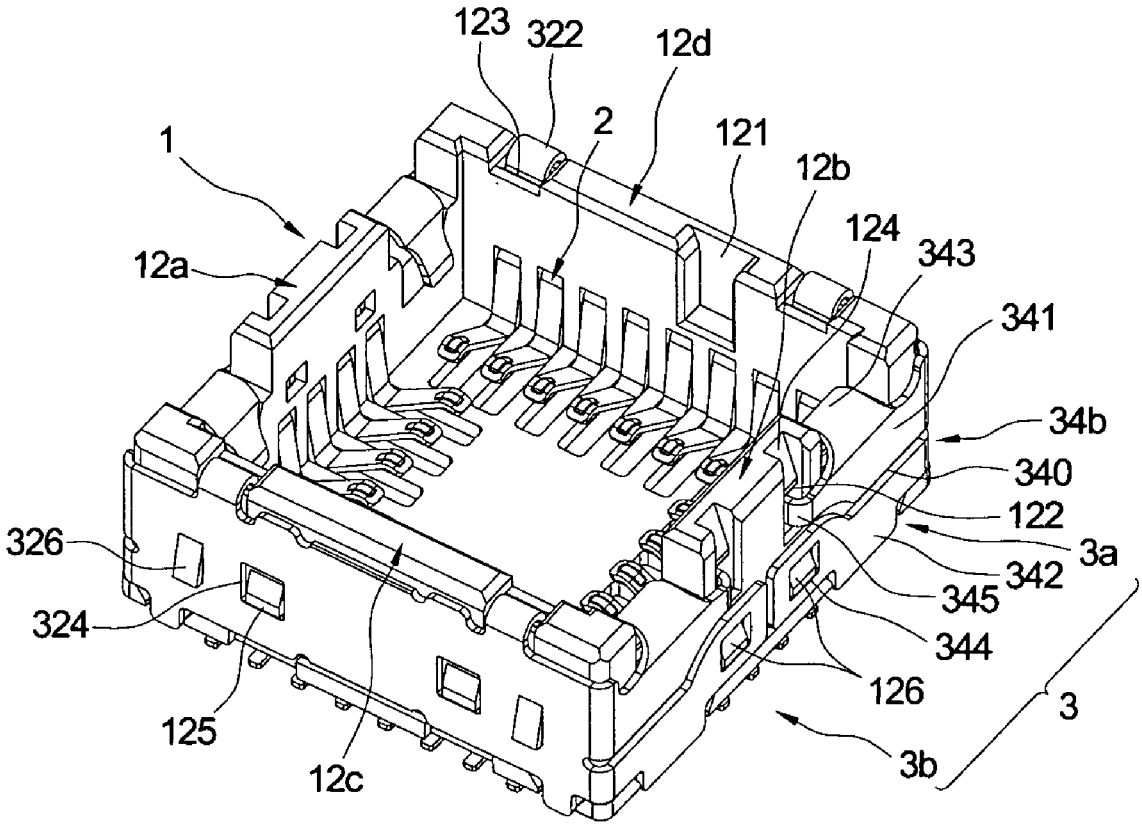
FIG. 3 is an assembled perspective view of the socket device (a shielding casing is not included) of the present invention.
Figure 4:
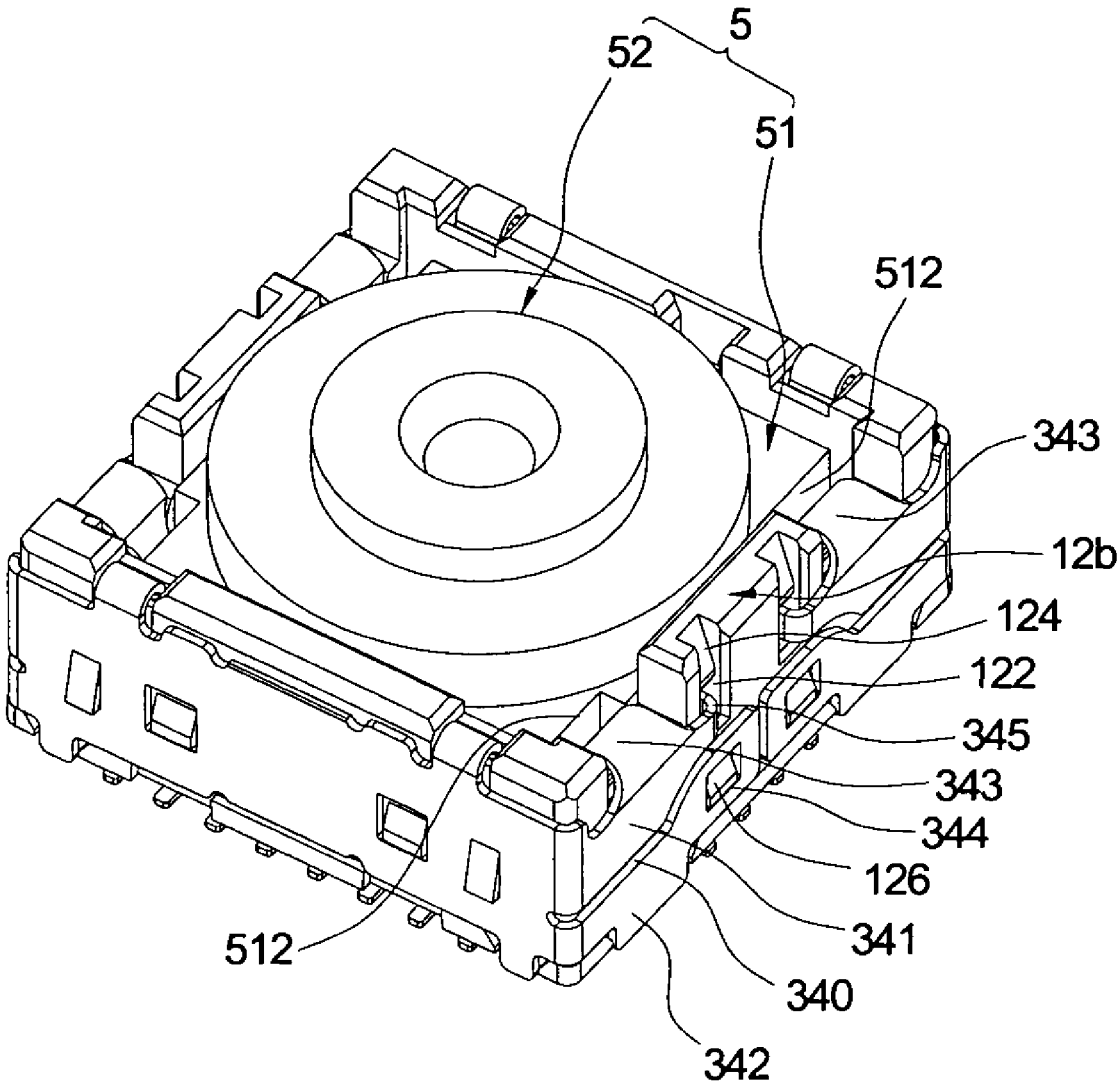
FIG. 4 is an assembled perspective view of the socket device (the shielding casing is not included) which an electronic component is assembled of the present invention.

References are made to FIG. 3 and FIG. 4, which are assembled perspective views of the socket device (the shielding casing is not included) of the present invention, wherein the FIG. 4 shows that the electronic component is assembled. The socket device of the present invention has feature as the followed. The holding casing 3 is covered and fixed with an outside of the insulating housing 1. Each of two sides of the holding casing 3 respectively forms at least one elastic arm 341. Each of the elastic arms 341 respectively forms a pressing portion 343, and a guiding portion 345. The pressing portion 343 is formed from a top edge of the holding casing 3 to the contained space 10 for pressing the electrical component 5. The guiding portion 345 is transversely extended from a free end to the contained space 10. Each of the guiding portions 345 is respectively slidably contained in the penetrating groove 122 of the insulating housing 1.

The holding casing 3 can be a square-shaped metal frame. A preferred embodiment of the present invention, the holding casing 3 is preferably composed of a pair of U-shaped semi-holding casings 3*a*, 3*b*. Therefore, the pressing portion 343 and the guiding portion 345 are easily made by punching, and further, the holding casing 3 is easily assembled.

References are made from FIG. 1 to FIG. 4. Each of the semi-holding casings 3*a*, 3*b* respectively has a housing wall 32 and a pair of side walls 34*a*, 34*b* that are installed on two sides of the housing wall 32. Each of the side walls 34*a*, 34*b* of the semi-holding casings 3*a*, 3*b* respectively has a transverse seam 340. The elastic arm 341 is disposed above the transverse seam 340, and a holding arm 342 is disposed below the transverse seam 340. Each of the semi-holding casing 3*a*, 3*b* respectively has a pair of pressing portions 343 and a pair of the guiding portions 345 for pressing four notches 512 of four corners of the electrical component 5.

Figure 5:
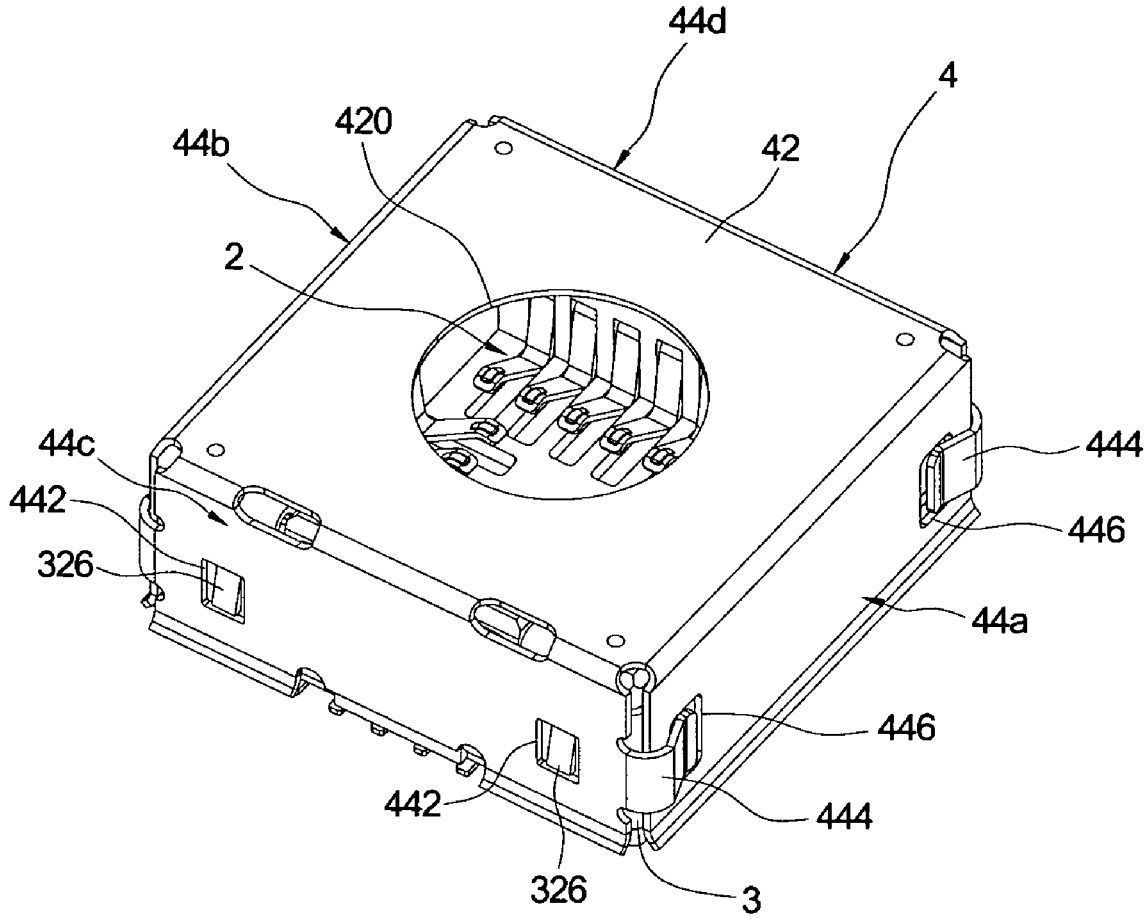
FIG. 5 is an assembled perspective view of the socket device which the electronic component is not contained of the present invention.
Figure 6:
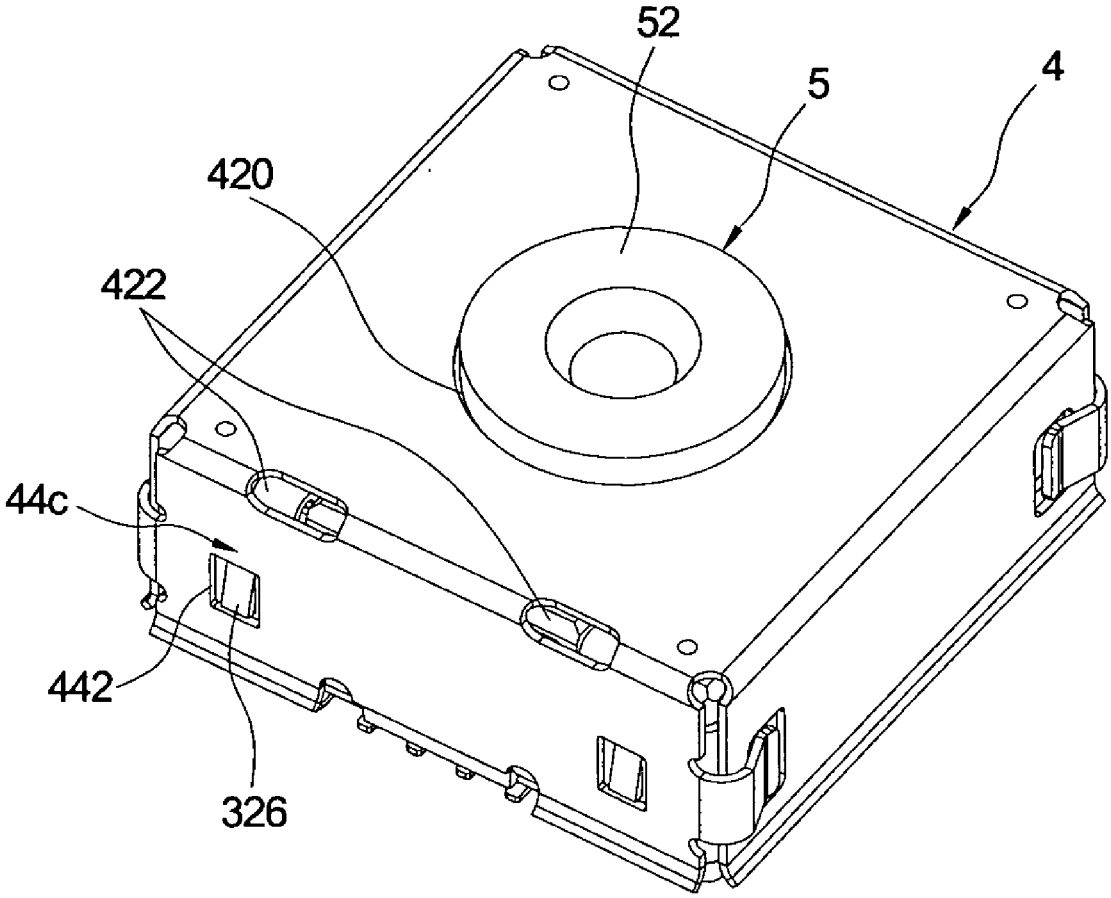
FIG. 6 is an assembled perspective view of the socket device which the electronic component is contained of the present invention.

References are made to FIG. 5 and FIG. 6, which are assembled perspective views of the socket device with the electronic component and without the electronic component of the present invention. The shielding casing 4 covers the holding casing 3, and has a square-shaped top board 42 and four side boards 44*a*, 44*b*, 44*c*, 44*d* that are downwardly extended from four edges of the top board 42. The top board 42 forms an opening 420 for exposing the electronic component 5. The shielding casing 4 forms a plurality of escape-proof holes 442. The holding casing 3 forms a plurality of escape-proof pieces 326 are outwardly corresponding to the escape-proof holes 442. Therefore, the shielding casing 4 can fix the electronic component 5 in the socket device. The shielding casing 4 has a plurality of through holes 422 for defining a correct direction of the shielding casing 4 while the shielding casing 4 is assembled into the insulating housing 1.

The side boards 44*a*, 44*b*, 44*c*, 44*d* of the shielding casing 4 are mutually separated and are mutually clasped by a hook 444 and a hook hole 446. In this embodiment, each of the side boards 44*a*, 44*b* respectively forms a pair of hook holes 446. Each of the side boards 44*c*, 44*d* respectively forms a pair of hooks 444 is extended from each of two sides of the side boards 44*c*, 44*d* for clasping the hook holes 446 of the side boards 44*a*, 44*b*. The side boards 44*a*, 44*b*, 44*c*, 44*d* of the shielding casing 4 provide plentiful space for assembling while the shielding casing 4 is covered with the outside of the holding casing 3.

Reference is made to FIG. 1. In order to prevent the electronic component 5 from being assembled into the insulating housing 1 in an incorrect direction, an inner side of the insulating housing 1 forms an anti-disorientating groove 121. One side of the electronic component 5 outwardly protrudes an anti-disorientating lump 511 corresponding to the anti-disorientating groove 121. It is shown in FIG. 1 and compared in FIG. 9 that a side wall 12*d* of the insulating housing 1 forms the anti-disorientating groove 121. The electronic component 5 is not assembled into the insulating housing 1 if an incorrect orientation between the electronic component 5 and the insulating housing 1.

For convenient assembly, each of the sides of the insulating housing 1 respectively outwardly forms at least one oblique guiding surface 124 for guiding the guiding portion 345. The oblique guiding surface 124 is relatively disposed above the penetrating groove 122. While the semi-holding casing 3*a*, 3*b* are assembled into the insulating housing 1. The elastic arms 341 of the semi-holding casings 3*a*, 3*b* are outwardly pushed along the oblique guiding surfaces 124 by the guiding portions 345, and the guiding portions 345 are inserted into the penetrating grooves 122 of the insulating housing 1.

References are made to FIG. 3 and FIG. 4. In the preferred embodiment, the transverse seam 340 is extended between the housing wall 32 of the semi-holding casings 3*a*, 3*b* and the side walls 34*a*, 34*b* of the semi-holding casings 3*a*, 3*b*. By way of experiment find out, if the transverse seam 340 is too short, it has strong rigidity and less elasticity so that it is difficult to be assembled. If the transverse seam 340 is too long (more then the length stated above), it has an elastic fatigue so as to damage the structure of the semi-holding casing 3*a*, 3*b*.

There is one thing worth to mentioned that a width of a root portion (source) of the elastic arm 341 is larger then a width of a free end thereof, and a width of a root portion (source) of the holding arm 342 is smaller then a width of a free end thereof. Therefore, the semi-holding casings 3*a*, 3*b* can provide a larger area for a front end of the holding arm 342 and forms a fastening hole 344 on each of the semi-holding casings 3*a*, 3*b*. The insulating housing 1 forms a plurality of fastening lumps 126 are corresponding to the fastening holes 344 for enhancing a fixed strength between the semi-holding casing 3*a*, 3*b* and the insulating housing 1. In addition, because the elastic arm 341 has the wider root portion, the elastic arm 341 has a strong elasticity without outwardly curving. And because the holding arm 342 has the narrower root portion, a bottom of the holding arm 342 further has a welding location for enhancing a fixed strength of the holding arm 342 while the semi-holding casings 3*a*, 3*b* are welded on the circuit board. Furthermore, the welding location is used to be a ground terminal so as to obtain a shielding effect.

In order to firmly fix the holding casing 3 on the insulating casing 1, each of the semi-holding casings 3*a*, 3*b* respectively forms two fastening holes 324 on the housing wall 32 and a fastening hole 344 on the side walls 34*a*, 34*b*. Each of the sides of the insulating housing 1 respectively forms a plurality of fastening lumps 125, 126 are corresponding to the fastening holes 324, 344.

Figure 7:
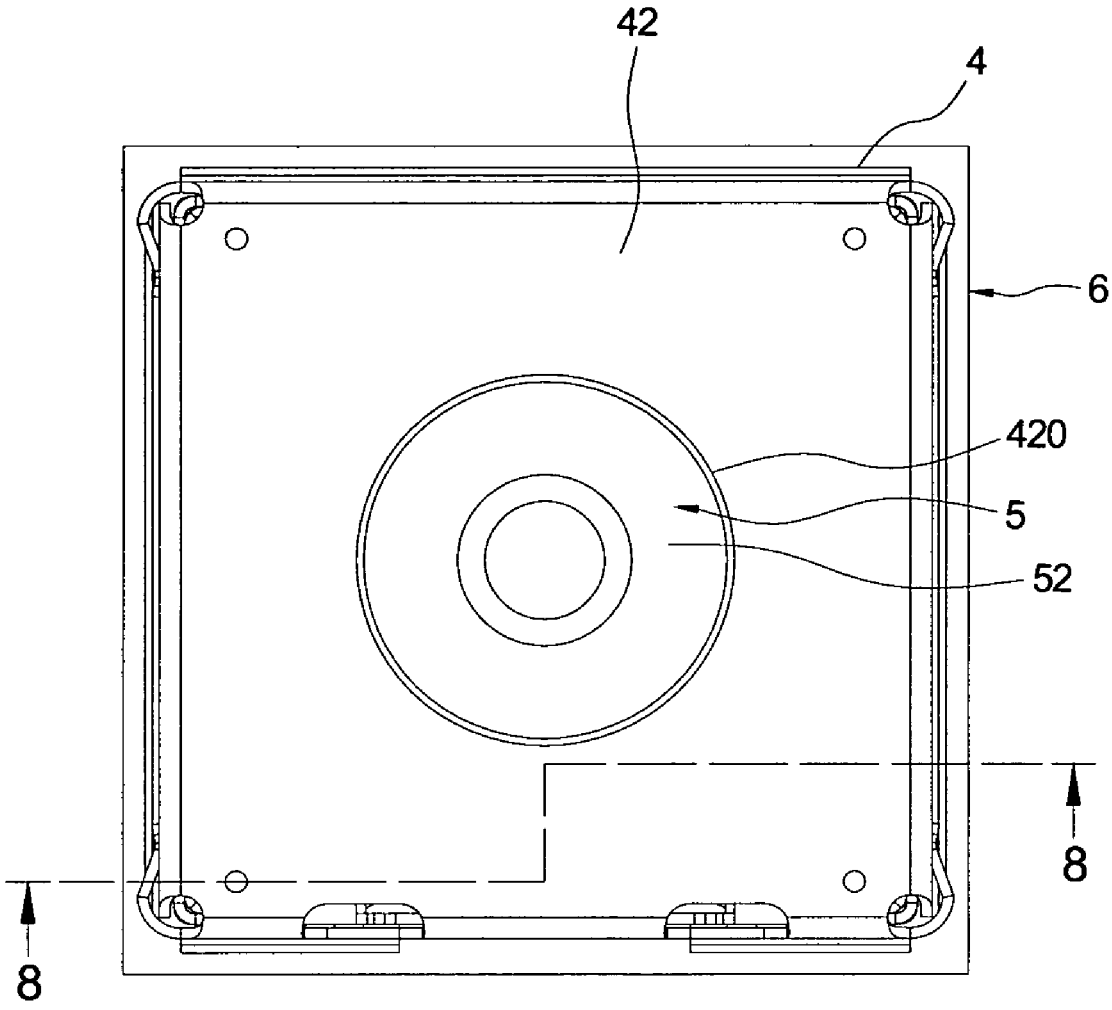
FIG. 7 is a top view of the socket device of the present invention.
Figure 8:
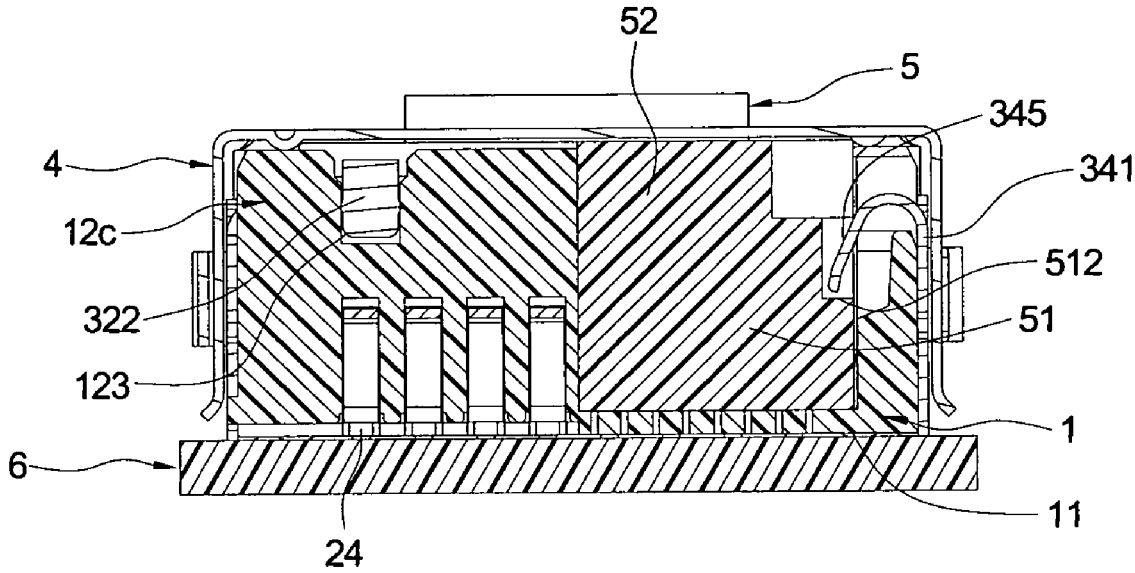
FIG. 8 is a cross-sectional view taken along line 8-8 of FIG. 7 of the present invention.

References are made to FIG. 7 and FIG. 8. FIG. 7 is a top view of the socket device of the present invention; and FIG. 8 is a cross-sectional view taken along line 8-8 of FIG. 7 of the present invention. Each of the housing walls of the semi-holding casings 3*a*, 3*b* forms an assembled portion 322 that is formed from a top edge of the housing wall 32 to the contained space. Each two sides of the assembled portion 322 has a protrudent structure. The insulating housing 1 forms a plurality of assembled grooves 123 are downwardly recessed from a top surface of the insulating housing 1 for the corresponding assembled portions 322 being fixed thereon.

Figure 9:
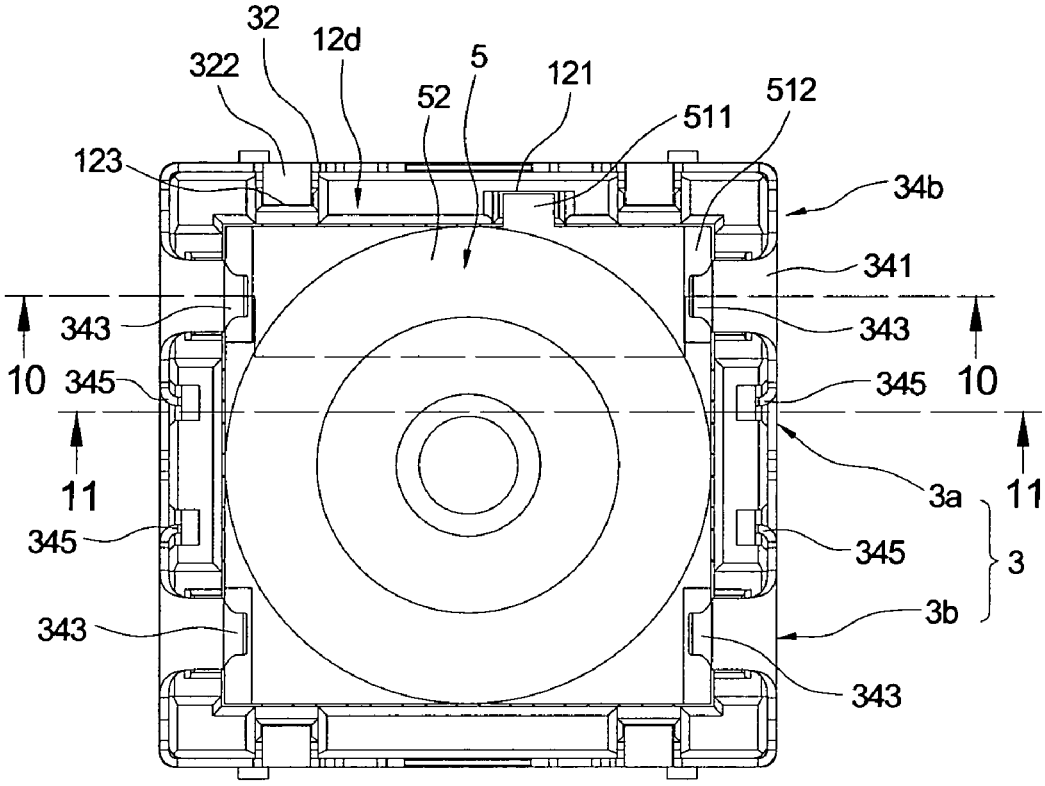
FIG. 9 is a bottom view of the socket device (the shielding casing is not included) of the present invention.
Figure 10:
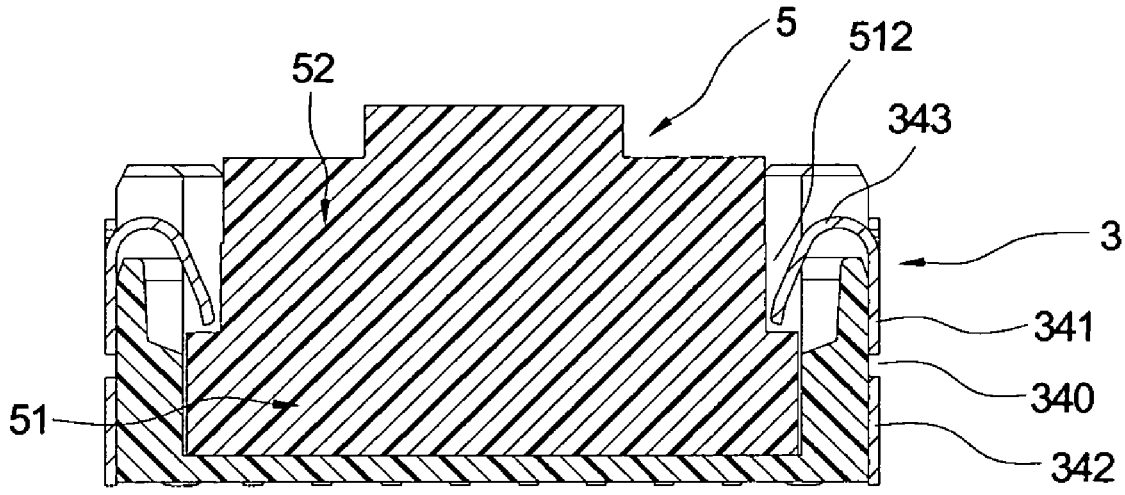
FIG. 10 is a cross-sectional view taken along line 10-10 of FIG. 9 of the present invention.
Figure 11:
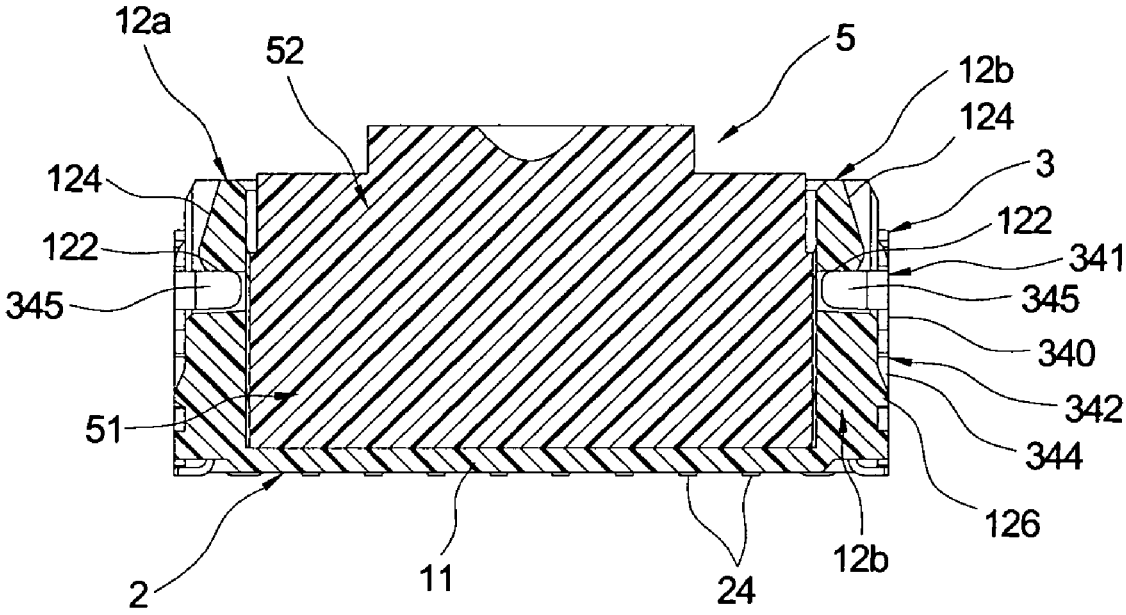
FIG. 11 is a cross-sectional view taken along line 11-11 of FIG. 9 of the present invention.

References are made from FIG. 9 to FIG. 11. FIG. 9 is a bottom view of the socket device (the shielding casing is not included) of the present invention. FIG. 10 is a cross-sectional view taken along line 10-10 of FIG. 9 of the present invention. FIG. 11 is a cross-sectional view taken along line 11-11 of FIG. 9 of the present invention. The feature of the present invention not only the pressing portions 343 of the elastic arms 341 press the electronic component 5 in the socket device, but also the guiding portions 345 of the elastic arms 341 are slidably passed through the insulating housing 1. The guiding portions 345 are contained in the penetrating grooves 112 of the insulating housing 1 so that the guiding portions 345 are not upwardly moved. The electronic component 5 is not upwardly floated so as to keep a good electrical contact between the terminals 2 and the component 5. In addition, because the guiding portions 345 are pressed on an upper wall of the inside of the penetrating grooves 122, a strong friction is formed between the guiding portions 345 and the upper wall of the inside of the penetrating grooves 122 so that the guiding portions 345 are not pulled out from the penetrating grooves 122 and the elastic arms 341 are not outwardly twisted. Hence, the electronic component 5 is firmly clasped by the elastic arms 341 of the guiding portions 345 so that the electronic component 5 is firmly fixed in the socket device while the electronic product falling out.

Furthermore, a width of a front end (free end) of the pressing portions 343 is narrower and a width of rear end (root portion) is wider to prevent the centralization of the inner stress that is resulted from contacting the pressing portions 343 to the electronic component 5. Therefore, the electronic component 5 is easily assembled and the socket device doesn't have a shape deformation during the assembly process.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A socket device, installed on a circuit board of an electronic product for containing an electronic component, comprising:

an insulating housing having a contained space for containing the electronic component, and each of two sides of the insulating housing respectively forming a horizontal penetration grooves;

a plurality of terminals installed in the contained space of the insulating housing and electrically connected with the electronic component; and a conductive holding casing covering the insulating housing, each of two sides of the holding casing respectively having elastic arms extending along thereon each of the elastic arms respectively forms a pressing portion formed from a top edge of the elastic arm and bent toward the contained space for pressing the electrical component, and a guiding portion transversely extended from a free end of the elastic arm and toward the contained space, each of the guiding portions respectively slidably received in a respective penetrating groove of the insulating housing, wherein the guiding portions on each side of the two sides of the holding casing position in between the pressing portions; whereby for preventing the elastic arm outwardly twisted and the electronic component upwardly floated.

2. The socket device as in claim 1, further comprising a shielding casing covered with an outside of the holding casing, the shielding casing having a square-shaped top board and four side boards downwardly extended from fours edges of the top board, and the top board forming a opening for exposing the electronic component.

3. The socket device as in claim 2, wherein the shielding casing forms a plurality of escape-proof holes, the holding casing forms a plurality of escape-proof pieces are outwardly corresponding to the escape-proof holes.

4. The socket device as in claim 2, wherein the side boards of the shielding casing are mutually separated and are mutually clasped by a hook and a hook hole.

5. The socket device as in claim 1, wherein an inner side of the insulating housing forms an anti-disorientating groove, one side of the electronic component outwardly protrudes an anti-disorientating lump is corresponding to the anti-disorientating groove.

6. The socket device as in claim 1, wherein each of the sides of the insulating housing respectively outwardly forms at least one oblique guiding surface for guiding the guiding portion, the oblique guiding surface is relatively disposed above the penetrating groove.

7. The socket device as in claim 1, wherein each of four inner surfaces of the insulating housing respectively forms a plurality of terminal-fixing grooves, the terminal-fixing grooves are connected with terminal through grooves are installed on a bottom wall of the insulating housing.

8. The socket device as in claim 7, wherein each of the terminals respectively has a fixed portion is fixed in the terminal-fixing groove of the insulating housing and a welding portion is downwardly extended from the fixed portion and passed through the terminal through groove of the insulating housing for electrically connecting with the circuit board, and a contacting portion is extended from the fixed portion to the contained space for pushing the electronic component.

9. The socket device as in claim 1, wherein the holding casing is composed of a pair of U-shaped semi-holding casings, each of the semi-holding casings respectively has a housing wall and a pair of side walls are installed on two sides of the housing wall, and each of the side walls of the semi-holding casings respectively has a transverse seam, the elastic arm is disposed above the transverse seam, and a holding arm is disposed below the transverse seam.

10. The socket device as in claim 9, wherein the transverse seam is extended between the housing wall of the semi-holding casing and the side wall of the semi-holding casing.

11. The socket device as in claim 9, wherein a width of the elastic arm is gradually larger from a free end to the housing wall, a width of the holding arm is gradually smaller from the free end to the housing wall.

12. The socket device as in claim 9, wherein each of the semi-holding casings respectively forms a plurality of fastening holes, each of the sides of the insulating housing respectively forms a plurality of fastening lumps are corresponding to the fastening holes.

13. The socket device as in claim 9, wherein each of the housing walls of the semi-holding casings forms an assembled portion is formed from a top edge of the housing wall to the contained space, the insulating housing forms a plurality of assembled grooves are downwardly recessed from a top surface of the insulating housing for correspondingly fixing the assembled portions on the insulating housing.

* * * * *